US005242165A

United States Patent [19]

Shubert

[11] Patent Number: 5,242,165

[45] Date of Patent: Sep. 7, 1993

[54] HAND COORDINATED BALL AND PLANK GAME

[76] Inventor: Charles W. Shubert, 1605 S. Blackhorse Pike, Williamstown, N.J. 08094

[21] Appl. No.: 903,335

[22] Filed: Jun. 24, 1992

[51] Int. Cl.[5] ..... A63F 7/00

[52] U.S. Cl. ..... 273/118 R; 273/109; 273/441; 273/449

[58] Field of Search ..... 273/108, 109, 110, 113, 273/115, 116, 118 R, 118 A, 123 R, 123 A, 441, 449, 76

[56] References Cited

U.S. PATENT DOCUMENTS

| | | | |
|---|---|---|---|
| D. 103,646 | 3/1937 | Van Ore . | |
| 271,530 | 1/1983 | Spang . | |
| 1,972,587 | 9/1934 | Fairchild | 273/109 |
| 2,409,373 | 10/1946 | Mautner et al. . | |
| 3,552,750 | 6/1971 | Lomberk et al. | 273/113 X |
| 3,712,620 | 1/1973 | Goldfarb et al. | 273/123 R X |
| 3,764,140 | 10/1973 | Lotfy | 273/76 X |
| 3,990,702 | 11/1976 | Chopp | 273/113 X |
| 5,066,014 | 11/1991 | Dobson | 273/123 R X |

*Primary Examiner*—V. Millin
*Assistant Examiner*—Raleigh W. Chiu
*Attorney, Agent, or Firm*—Richard C. Litman

[57] ABSTRACT

In an apparatus and method for playing a hand-eye coordination game, a plank and "Ping Pong" type ball are provided. The plank has a hole at an end near the handle and another hole at the opposing end. The object of the game is to maneuver a ball from the hole near the handle to the opposing end and back, thereby completing a "walk on the plank", without touching the ball or having the ball fall off of the plank. Variations include apertures within the plank, pegs selectively inserted in the apertures, and playing surfaces of a planar and a non-planar construction. The player's manual dexterity is enhanced by playing the game.

12 Claims, 1 Drawing Sheet

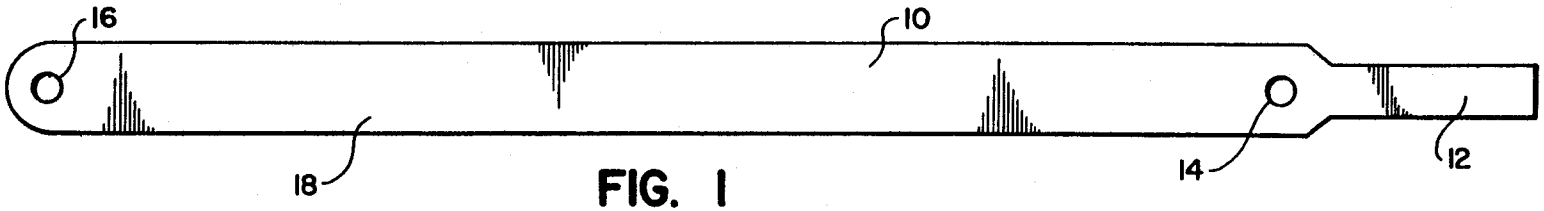
FIG. 1
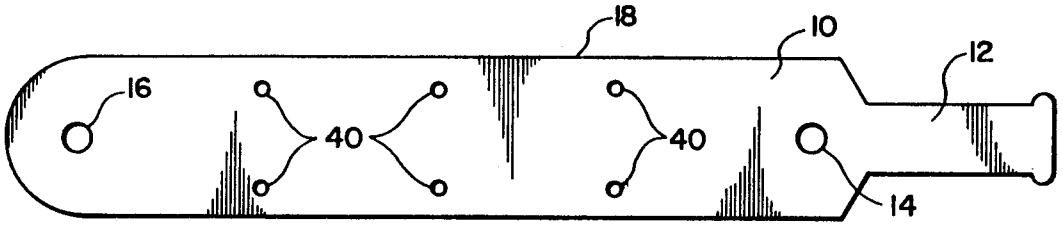
FIG. 4
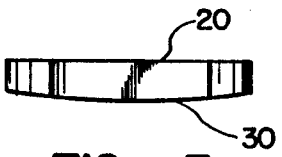
FIG. 3
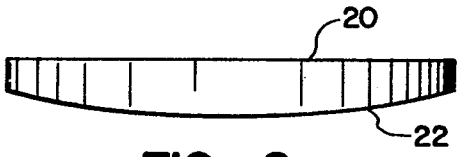
FIG. 2
FIG. 5
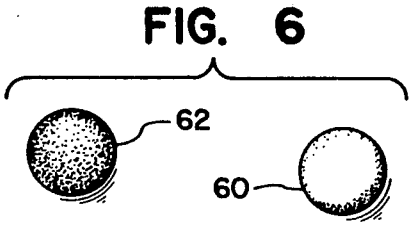
FIG. 6
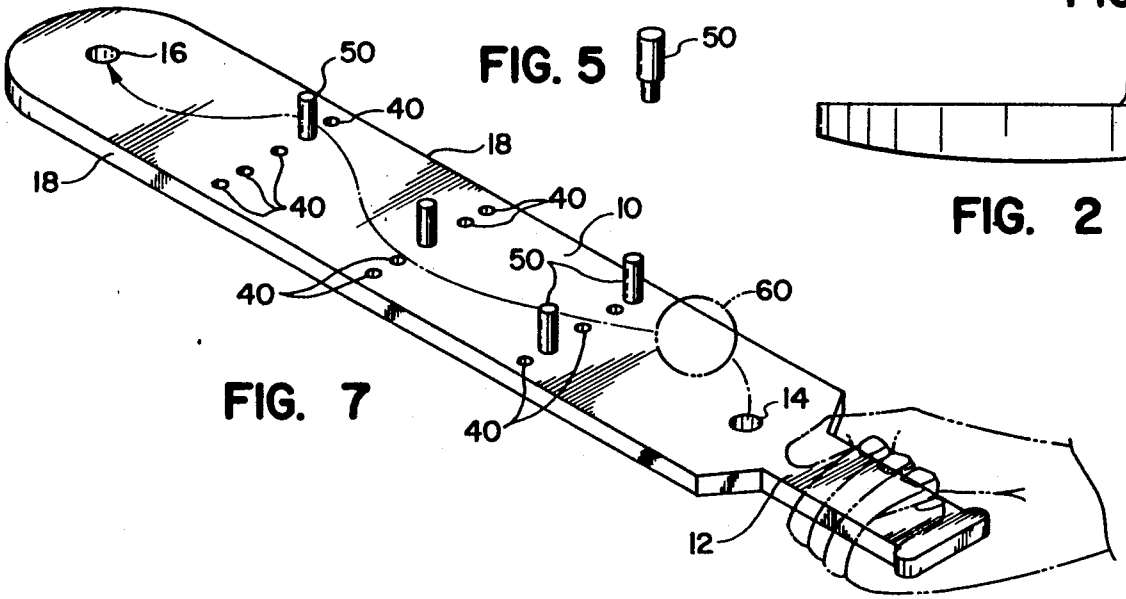
FIG. 7

HAND COORDINATED BALL AND PLANK GAME

BACKGROUND OF THE INVENTION

1. Field of the Invention

This invention relates to a hand held plank used as a playing field for a hand coordinated game. More specifically, the plank has a hole at each end for receiving a ping pong type ball, which the player seeks to move from hole to hole without touching the ball and without having the ball fall off the plank.

2. Description of the Prior Art

Game boards having holes therethrough for receiving a game ball and/or pegs are well known in the prior art.

U.S. Design Pat. No. 103,646, issued on Mar. 16, 1937, to L. W. Van Ore, and U.S. Design Pat. No. 319,086, issued to Vincent H. Hughes, for a game paddle, both disclose designs for game devices having holes therein which may be used to enable a ball to roll from one hole to another.

U.S. Pat. No. 271,530, issued on Jan. 30, 1883, to J. D. Spang, discloses a game board tilted relative to the horizontal having a plurality of insertable pins and ramps serving as obstacles to one or more balls which are rolled from one end of the board to the other. This is a horse racing game played on a table, wherein the game board has sides to keep balls (horses) from falling off the playing surface.

U.S. Pat. No. 2,409,373, issued on Oct. 15, 1946, to 0. Mautner, et. al., for a gaming device, shows a manipulative game board in the form of a paddle, wherein the board has recesses of variable configuration, and game pieces of similar configuration having shiftable balls contained therein to shift the center of gravity, whereby the game pieces may be moved to the recesses by shifting the game board or paddle. Like the Spang Patent, this Patent has walls surrounding the edge of the game board to prevent the game pieces from falling off.

SUMMARY OF THE INVENTION

None of these patents, or any other inventions known, taken either singly or in combination, disclose the invention herein of a hand held plank of various widths and various lengths used in conjunction with a "Ping Pong" type ball whereby the ball traverses the plank which serves as a playing field. Further, the instant invention discloses a playing surface having no peripheral upward projections, in that the plank is constructed so that an object of the game is to keep a ping pong type ball on the playing surface, or suffer a loss of points and/or a loss of turn. The plank of the instant invention can be constructed so that on each side of the plank is a playing surface of differing levels of difficulty. Accordingly, the apparatus and method of the instant invention is a novel improvement in the field of hand held coordination games.

OBJECTS OF THE INVENTION

It is an object, advantage and feature of the invention to provide a game which improves a player's manual dexterity.

It is another object, advantage and feature of the invention to provide a playing surface in the form of a plank of various widths and various lengths, and a ping pong type ball for use with the plank in playing a game.

It is a further object, advantage and feature of the invention to provide a playing surface having no peripheral upward projections so that the game objective of keeping a ball on the playing surface is more difficult to achieve.

It is another object, advantage and feature of the invention to provide a game playing device having a plurality of playing surfaces on which a game can be played.

It is another object, advantage and feature of the invention to provide a game playing surface that is planar in construction.

It is another object, advantage and feature of the invention to provide a game playing surface that is non-planar in construction.

It is another object, advantage and feature of the invention to provide a game playing surface having a hole at each end thereof for manipulating a ball from one hole to the other while playing a game.

It is a further object, advantage and feature of the invention to provide a plurality of apertures between the two holes at each end of the playing surface to increase the difficulty in playing a game.

It is still another object, advantage and feature of the invention to provide pegs which can be selectively positioned within one or more apertures between the holes at each end of the playing surface to increase the difficulty of the game.

It is another object, advantage and feature of the invention to provide a game wherein more than one "Ping Pong" type ball is used to play the game.

And, lastly, it is an object, advantage and feature of the invention to provide a novel game apparatus and method of playing a game which requires hand-eye coordination and improves the player's manual dexterity the more the game is played.

These and other objects of the present invention will become readily apparent by reference to the drawing, description and claims.

BRIEF DESCRIPTION OF THE DRAWINGS

FIG. 1 is a top view of one embodiment of the game device.

FIG. 2 is a front view of another embodiment of the game, wherein one playing surface is flat and the other playing surface is convex in construction.

FIG. 3 is a front view of another embodiment similar to that shown in FIG. 2.

FIG. 4 is a top view of the game device, showing apertures on the playing surface.

FIG. 5 is a perspective view of a peg used in conjunction with the version of the playing surface shown in FIG. 4.

FIG. 6 shows a perspective view of a "Ping Pong" type ball used to play the game.

FIG. 7 shows a version of the game playing surface having apertures as shown as FIG. 4 wherein pegs shown in FIG. 5 are inserted in the apertures in selected locations.

Like numerals identify like components throughout the description herein.

DETAILED DESCRIPTION OF THE PREFERRED EMBODIMENT(s)

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

Referring now to the drawing, plank 10 and ball 60 are used to play a game wherein hand-eye coordination is required in seeking to score the most points within a time period established by the players. The plank 10 can be constructed so that the length and/or width can vary, as can other features discussed herein, affecting the level of difficulty of the game played thereon. To play the game, a player uses either hand to grasp handle 12 of plank 10. With his or her arm comfortably extended, the player would place ball 60 in hole 14, which is located near the handle 12. With a flick of the player's thumb, ball 60 rolls on plank 10. The objective is to have ball 60 reach hole 16 on the other end of the plank 10 without falling off plank 10. This is a accomplished by balancing and leveling ball 60 while holding plank 10 in a position whereby gravity causes ball 60 to move toward hole 16. When ball 60 is manipulated finally into hole 16, the player while keeping the plank 10 relatively level, utilizes a jerking motion to cause ball 60 to become ajar from hole 16, being careful to avoid ball 60 from falling off plank 10. Now, the player must bring ball 60 back from hole 16 to settle in hole 14 near his or her hand, without ball 60 falling off plank 10, and without touching ball 60 with his or her hands. This back and forth maneuver once completed is deemed a "walk on the plank".

Typically, the game is played for a time period set by the players, wherein points are scored when a "walk on the plank" has been completed. Points are deducted when ball 60 falls off of plank 10, or if the player's hand touches ball 60. For example, a player would receive 2 points for a "walk on the plank", but would be deducted 1 point for each time ball 60 touches his or her hand, and would be deducted 2 points for each time ball 60 falls off of plank 10, in addition to the player losing his or her turn.

By using a "Ping Pong" type ball 60, ideally of a diameter of one and one half inches, the player has difficulty manipulating the ball 60. This difficulty arises because of unpredictable or erratic motion of "Ping Pong" balls due to imbalance in the structure of such balls. Balls having this characteristic, in combination with being light weight and non-resilient, will be referred to as being "Ping Pong" type balls. This adds to the excitement of the game and the need for the player to develop manual dexterity in order to excel at playing the game in accordance with the typical rules.

In another version of the game the player places ball 60 in hole 14 at the beginning of the game and a second ball 62 in hole 16 at the opposing end of plank 10. Ball 60 could be white in color and ball 62 black in color. In this version, to "walk the plank" the player must move the white ball 60 from hole 14 to hole 16 and move the black ball 62 from hole 16 to hole 14, and then back to the original respective positions of the balls 60, 62.

Another version of the game has plank 10 constructed with apertures 40 at a plurality of locations on plank 10. Apertures 40 would extend from the top surface of plank 10 through the bottom surface thereof. These apertures 40 provide obstacles for a player in completing a "walk on the plank". In apertures 40, pegs 50 can be positioned as desired. Each aperture 40 can have a peg 50 inserted therein, or selected apertures 40 can have pegs 50 positioned so that the level of difficulty can be varied. In this version, an exciting obstacle course is created whereby a player may need to cause ball 60 to hop on plank 10 to move from hole 14 to hole 16. The player may also need to utilize edge 18 strategically in maneuvering the ball 60 around peg 50 in accomplishing a "walk on the plank". The player can also hold the plank 10 so that natural or artificial light passes through apertures 40, providing an illumination effect during play.

As is apparent, plank 10 can be constructed in a variety of ways. It can have two playing surfaces, one on each side. One playing surface can be a planar (flat) surface 20, and the other could be a non-planar surface such as convex surface 22. FIG. 3 shows a convex surface 30 having a greater degree of curvature than convex surface 22 shown in FIG. 2. If plank 10 is constructed in such manner, a single playing device would have a game on one side having a lesser level of difficulty (surface 20) than a game on the other side (surface 22). In such a version apertures 40, which can pass through surface 20 to surface 22, can be used with pegs 50 at desired locations as seen in FIG. 7.

The embodiments of the invention discussed herein are examples and are not the only ways of constructing the gaming device of the invention. Other variations are considered within the scope of the invention and the spirit of the claims appended hereto.

What is claimed is:

1. A hand held gaming device comprising:

a ball, a plank having a proximal end and a distal end, said plank further having a handle at said proximal end, said plank also having first means defining a first hole therein proximate said proximal end, and said plank having second means defining a second hold therein, said second hold being located at said distal end of said plank, said first and second holes partially retaining said ball therein, said plank having two playing fields, each of said playing field being defined by one side of said plank, one of said playing fields having a non-planar surface, and said plank being unencumbered by peripheral upward projections which would retain said ball on said plank, whereby said ball is subject to rolling upon said plank in the absence of a player's manipulation to prevent such rolling, whereby when said gaming device is held by a player, the player manipulates said plank so as to move said ball from one of said first and second holes to the other of said first and second holes, and then back, all the while attempting to avoid touching said ball with the player's hand, and maintaining said ball on said plank.

2. A gaming device as described in claim 1, wherein said one of said playing fields is convex in configuration.

3. A gaming device as described in claim 1, wherein another of said playing fields is planar in configuration.

4. A gaming device as described in claim 1, wherein said plank has apertures therein.

5. A gaming device as described in claim 4, wherein pegs are provided for selective insertion in said apertures.

6. A gaming device as described in claim 5, wherein another of said playing fields is planar in configuration.

7. A gaming device as described in claim 5, wherein said one of said playing fields has a convex configuration.

8. A gaming device as described in claim 1, wherein a plurality of balls are used to play the game.

9. A hand held gaming device comprising:

a lightweight hollow ball, a plank having a proximal end and a distal end, said plank further having a handle at said proximal end, said plank also having first means defining a first hole therein proximate said proximal end, and said plank having second means defining a second hole therein, said second hole being located at said distal end of said plank, said first and second holes partially retaining said ball therein, said plank having two playing fields, each of said playing fields being defined by one side of said plank, one of said playing fields having a non-planar surface defined on one side of said plank, said plank being unencumbered by peripheral upward projections which would regain said ball on said plank, whereby said ball is subject to rolling upon said plank in the absence of a player's manipulation to prevent such rolling, whereby when said gaming device is held by a player, the player manipulates said plank so as to move said ball from one of said first and second holes to the other of said first and second holes, and then back, all the while attempting to avoid touching the ball with the player's hand, and maintaining said ball on said plank.

10. A method for playing a hand coordination game comprising the following steps:

providing a lightweight hollow ball and a plank having a length and a width, the plank having a top surface and a bottom surface, the top surface and bottom surface having a playing field thereon which may be selectively planar and non-planar in configuration, the playing fields being unencumbered by peripheral upward projections, the plank having a handle thereon for holding by a player, the plank also having a hole thereon near the handle, and another hole at the opposing end of the plank;

grasping the handle in one hand by a player;

placing a ball in the hole near the handle;

touching the ball to cause the ball to move on the plank;

manipulating the plank to have the ball move toward the hole on the opposing end of the plank;

manipulating the ball into the hole on the opposing end of the plank;

urging the ball free from the hole on the opposing end of the plank and back toward the hole near the handle;

manipulating the ball into the hole near the handle;

scoring points in playing the game by completing the movement of the ball from the hole near the handle to the hole on the opposing end of the plank and back, and deducting points when the ball touches the hands of the player or falls off the plank, and in such instance, the player's turn ends.

11. The method as described in claim 10, wherein the plank has apertures therein, requiring the additional step of:

maneuvering the ball to avoid to grazing the apertures, and, if grazing does occur, to avoid such grazing from causing the ball to fall off the plank.

12. The method as described in claim 11, wherein pegs are selectively provided in the apertures, requiring the additional step of:

maneuvering the ball around the pegs so that impact with the pegs does not cause the ball to fall off of the plank.

* * * * *